US007145475B2

(12) United States Patent
Kavner

(10) Patent No.: US 7,145,475 B2
(45) Date of Patent: Dec. 5, 2006

(54) PREDICTIVE AUTOMATIC INCIDENT DETECTION USING AUTOMATIC VEHICLE IDENTIFICATION

(75) Inventor: Douglas M. Kavner, Orange, CA (US)

(73) Assignee: Raytheon Company, Waltham, MA (US)

( * ) Notice: Subject to any disclaimer, the term of this patent is extended or adjusted under 35 U.S.C. 154(b) by 735 days.

(21) Appl. No.: 09/805,849

(22) Filed: Mar. 14, 2001

(65) Prior Publication Data

US 2002/0000920 A1 Jan. 3, 2002

Related U.S. Application Data

(60) Provisional application No. 60/189,858, filed on Mar. 15, 2000.

(51) Int. Cl.
*G08G 1/01* (2006.01)

(52) U.S. Cl. ..... 340/933; 340/934; 340/937; 235/384; 701/117; 701/118; 701/119

(58) Field of Classification Search ..... 340/934, 340/905, 933, 937; 235/384; 701/117, 118, 701/119

See application file for complete search history.

(56) References Cited

U.S. PATENT DOCUMENTS

| | | | | |
|---|---|---|---|---|
| 4,555,618 | A | 11/1985 | Riskin | |
| 4,963,723 | A | 10/1990 | Masada | |
| 4,979,221 | A | 12/1990 | Perryman et al. | |
| 5,227,803 | A | 7/1993 | O'Connor et al. | |
| 5,253,162 | A | 10/1993 | Hassett et al. | |
| 5,289,183 | A * | 2/1994 | Hassett et al. | 340/905 |
| 5,310,999 | A | 5/1994 | Claus et al. | |
| 5,422,473 | A * | 6/1995 | Kamata | 235/384 |
| 5,485,520 | A | 1/1996 | Chaum et al. | |
| 5,498,038 | A | 3/1996 | Simon et al. | |
| 5,651,075 | A | 7/1997 | Frazier et al. | |
| 5,675,494 | A | 10/1997 | Sakurai et al. | |
| 5,684,475 | A * | 11/1997 | Krause et al. | 340/934 |
| 5,696,502 | A * | 12/1997 | Busch et al. | 340/905 |
| 5,696,503 | A | 12/1997 | Nasburg | |
| 5,801,943 | A * | 9/1998 | Nasburg | 701/117 |
| 5,948,038 | A * | 9/1999 | Daly et al. | 701/117 |
| 6,042,008 | A | 3/2000 | Ando et al. | |
| 6,078,895 | A | 6/2000 | Ryu et al. | |
| 6,109,525 | A | 8/2000 | Blomqvist et al. | |
| 6,111,523 | A * | 8/2000 | Mee | 340/937 |

(Continued)

FOREIGN PATENT DOCUMENTS

EP 0 632 410 A2 1/1995

(Continued)

OTHER PUBLICATIONS

D. Rittich et al., "Perspektiven Der Verkehrsleittechnik", Nachrichtentechnische Berichte, ANT Nachrichtentechnik Gmb. Backnang, DE, No. 9, Apr. 9, 1992, pp. 111-119.

(Continued)

*Primary Examiner*—Julie Bichngoc Lieu
(74) *Attorney, Agent, or Firm*—Daly, Crowley, Mofford & Durkee, LLP

(57) ABSTRACT

A system and method for detecting incidents along a roadway are provided. A plurality of readers are spaced at intervals along a roadway for reading uniquely identified data from each of a plurality of vehicles. These readings are correlated to obtain information on each of the vehicles and to determine the number of vehicles potentially affected by incidents along the roadway. Finally, the number of each of the vehicles potentially affected by incidents is compared to a sample threshold in order to determine if a traffic incident has occurred.

37 Claims, 4 Drawing Sheets

U.S. PATENT DOCUMENTS

| | | | | |
|---|---|---|---|---|
| 6,140,941 | A | 10/2000 | Dwyer et al. | |
| 6,177,885 | B1 * | 1/2001 | Weil et al. | 701/117 |
| 6,449,555 | B1 | 9/2002 | Ohba et al. | |
| 6,922,156 | B1 | 7/2005 | Kavner | |
| 2002/0140577 | A1 | 10/2002 | Kavner | |
| 2002/0140579 | A1 | 10/2002 | Kavner | |

FOREIGN PATENT DOCUMENTS

| | | | |
|---|---|---|---|
| EP | 0632410 | | 1/1995 |
| EP | 0 767 446 | | 4/1997 |
| EP | 0 767 446 | A2 | 4/1997 |
| EP | 0 779 600 | A2 | 6/1997 |
| EP | 0779600 | | 6/1997 |
| EP | 0 903 916 | | 3/1999 |
| EP | 0 903 916 | A2 | 3/1999 |
| GB | 2154832 | | 9/1985 |
| GP | 2 154 832 | A | 9/1985 |
| JP | 07254099 | | 10/1995 |
| JP | 2000057483 | | 2/2000 |
| WO | 9933027 | | 7/1999 |
| WO | WO 99/33027 | | 7/1999 |
| WO | 0169569 | | 9/2001 |

OTHER PUBLICATIONS

Patent Abstracts of Japan, Publication No. 2000 057483, Published on Feb. 25, 2000, Nippon Telegr. & AMP; Teleph Corp.

Patent Abstracts of Japan, Publication No. 07254099, Published on Oct. 3, 1995, Toshiba Corp.

International Search Report of Application No. PCT/US01/40298.

International Search Report of PCT Application No. PCT/US02/03924 mailed Oct. 21, 2002.

International Search Report of PCT Application No. PCT/US02/02472 mailed Dec. 9, 2002.

Rittich et al.; "Perspektiven der Verkehrsleittechnik;" ANT-Nachrightentechinsche Berichte; Apr. 1992; No. 9; 10 sheets.

"Vehicle Imaging System (VIS) Subsystem;" PULINX Preliminary Data Sheet; Rev. Apr. 15, 1999; 2 sheets.

Video Image Capture (VIC) Subsystem; PULNIX Preliminary Data Sheet; Rev. Dec. 16, 1998; 2 sheets.

Video Image Processing (VIP) Computer; PULNIX Preliminary Data Sheet; Rev. Dec. 16, 1998; 1 sheet.

PCT Search Report; PCT/US02/02472; dated Dec. 9, 2002.

PCT Search Report; PCT/US02/03924; dated Oct. 21, 2002.

"Introduction to Safe-T-Cam;" Safe-T-Cam from internet website http://www.rta/nsw.gov.au/registration/heavyvehicleinformation/safetcam.index.html; Dec. 22, 2003; 3 sheets.

"Introduction to Safe-T-Cam;" Safe-T-Cam from internet website http://www.rta/nsw.gov.au/registration/heavyvehicleinformation/safetcam/; Nov. 27, 2003; 2 sheets.

* cited by examiner

PREDICTIVE AUTOMATIC INCIDENT DETECTION USING AUTOMATIC VEHICLE IDENTIFICATION

CROSS-REFERENCE TO RELATED APPLICATIONS

This application claims priority under 35 U.S.C. § 119(e) from U.S. provisional application No. 60/189,858 filed on Mar. 15, 2000.

FIELD OF THE INVENTION

This invention relates generally to traffic control systems and more particularly to automatically predicting traffic incidents using automatic vehicle identification.

BACKGROUND OF THE INVENTION

In traffic control applications, it is often desirable to detect traffic incidents that cause a disruption in the flow of traffic. Conventional traffic management systems use sensors that monitor the presence and speed of vehicles without individually identifying each vehicle. Such systems rely on gathering data from traffic helicopters, camera systems, and sensors to detect the presence of a vehicle. One such system includes an induction loop buried in a roadway.

Conventional systems typically use incident detection algorithms that process the sensor data and declare when an incident has occurred. One such algorithm includes detecting a queue of vehicles that forms because a traffic incident causes a backup in a roadway. There is a need to minimize the rate of false alarms while attempting to quickly detect the formation of a queue. A false alarm occurs when a queue is incorrectly detected and an incident is declared by the algorithm but has not in fact occurred. One solution to this problem requires close sensor spacing (about one km) to quickly detect that a queue is forming. Closely deployed sensors are expensive in terms of infrastructure and maintenance costs.

There have been attempts to monitor the time required for a small set of vehicles to travel various sections of highway. These vehicles have special instrumentation that allows the vehicles to record time and location while traveling on the roadway. These attempts have mainly been for traffic reporting purposes rather than incident detection.

Conventional traffic control systems require several operators and expensive remote control cameras with zoom, pan and tilt features. These systems can miss traffic problems on sections without cameras. In addition there is no early warning of traffic incidents. Other industry standard algorithms use data collected by induction loop sensors that can measure the number of vehicles and speeds of the vehicles. These algorithms wait for queues to build up before detecting problems. These systems require closely spaced sensors because queues can build up anywhere on the roadway and information about the travel time of individual vehicles is not being collected and processed.

U.S. Pat. No. 5,696,503 entitled "Wide Area Traffic Surveillance Using a Multisensor Tracking System," and assigned to Condition Monitoring Systems, Inc, describes a wide area traffic surveillance using a multi-sensor tracking system. This system attempts to track individual vehicles within a sensor's field of view in a manner similar to an air traffic control radar system.

In order to detect incidents anywhere on the road within, for example five minutes, sensor spacing cannot exceed the size of the queue that develops five minutes after an incident. If the sensors were widely spaced, a conventional algorithm might not detect a queue build up for several minutes because the sensor might be located a distance, equal to traveling five minutes at an average speed, before the occurrence of an incident. Where the traffic flow is light, an incident would only cause the formation of a short queue of vehicles. A conventional system would require sensors to be spaced less than 500 meters apart to detect the short queue within five minutes.

By rapidly detecting traffic incidents on a roadway, emergency personnel can be dispatched to minimize the time that traffic lanes are blocked. For a roadway operating near capacity, it can take longer for a queue to clear than the time that the incident actually blocks traffic. It is therefore important to reduce the potential backlog of traffic by rapid detection.

SUMMARY OF THE INVENTION

It is an object of the present invention to automatically detect traffic incidents on a highway, with a system having full road coverage, limited operator intervention and widely spaced sensors.

It is another object of the present invention to detect incidents anywhere on roadways with relatively low traffic volumes quickly without needing to provide closely spaced sensors.

In accordance with an aspect of the present invention, a method is provided to detect incidents along a roadway including the steps of arranging a plurality of readers at spaced intervals along a roadway for reading uniquely identified data from each of a plurality of vehicles, and correlating the data with previously read data to obtain information on each of the plurality of vehicles, determining the number of each of said plurality of vehicles potentially affected by incidents along the roadway. Additionally the method includes the step of comparing the number of each of the plurality of vehicles potentially affected by incidents to a sample threshold. With such a technique, the method can detect incidents by analyzing data from widely spaced automatic vehicle identification (AVI) readers along a roadway where a significant portion of vehicles have transponders. The inventive method can detect many types of incidents faster using data from widely spaced sensors than conventional methods can using closely spaced sensors because the system does not merely measure the time taken to travel from one point to another for every vehicle, rather it actively monitors every transponder equipped vehicle on the roadway in real-time and determines when a statistically significant number are overdue or arrive early accounting for varying roadway and traffic conditions.

In accordance with a further aspect the present invention, thresholds used to determine overdue and early arriving vehicles are adjusted according to the roadway usage. With such a technique, the incident detection method is capable of accounting for variations in individual vehicle speed due to the possible presence of law enforcement personnel, varying road grades, mechanical breakdowns, service/rest station stops, vehicles entering from on-ramps, and vehicles exiting on off-ramps between sensor locations.

One of the novel features in this present invention is the ability to detect incidents without having to directly sense the incident or the backlog caused by the incident. An overdue vehicle does not have to be detected at the end of the segment in which it is traveling before an incident can be declared. An early arriving vehicle provides information on possible incidents near the start of the previous segment. Therefore the incident detection system is able to detect incidents without the need for closely spaced automatic vehicle identification (AVI) readers. The present invention does not require complete tracking of every vehicle on the roadway and can function when only a fraction of the vehicles are equipped with AVI transponders. The algorithms used in the present invention can accommodate vehicles that stop or slow down in a given segment due to reasons other than an incident.

In accordance with a further aspect the present invention, a traffic incident detection system includes a traffic management center processor connected to a data network, and a plurality of unique vehicle data readers connected to the data network such that uniquely identified data is read from each of a plurality of vehicles. The system further includes a correlation processor, where the uniquely identified data is correlated to obtain a count of overdue vehicles and early arriving vehicles, and an incident detection processor. With such an arrangement, a traffic management system is provided that can detect incidents without a requirement for closely spaced sensors.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
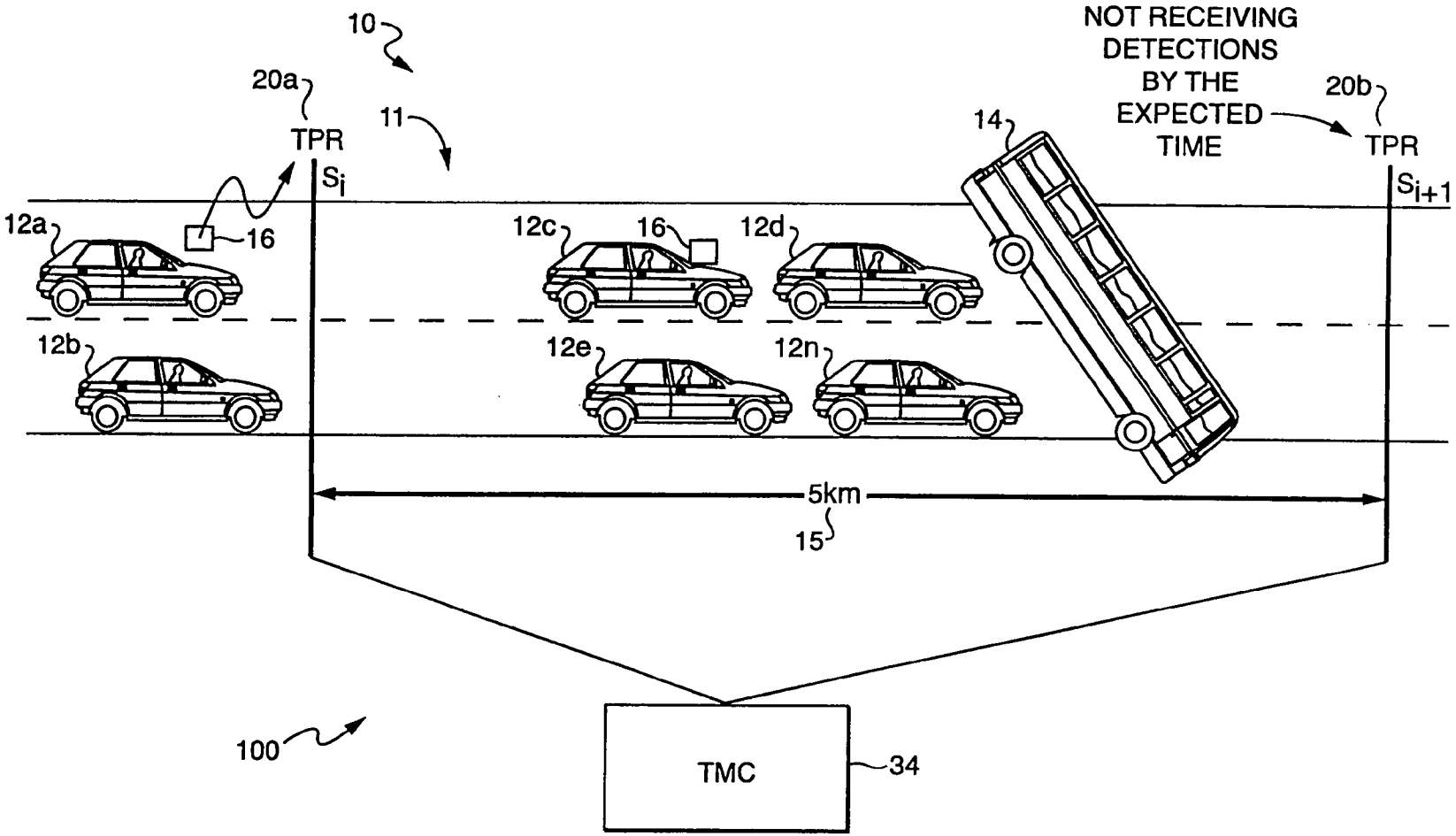
FIG. 1 is a schematic diagram of a roadway having traffic probe readers arranged to detect a traffic incident.

Referring now to FIG. 1, an incident detection system 100 includes a traffic management center (TMC) 34 connected to a plurality of traffic probe readers (TPR's) 20*a*–20*n* (generally denoted TPR 20) along a roadway 10 separated by interval 15. The roadway 10 includes a number of segments 11 (generally designated $S_i$ 11) which are typically located between a pair of TPR's 20 or other devices that can detect vehicles. It should be appreciated that the length of interval 15 between each pair of TPR's 20 is only approximate and does not have to be uniform between TPR's 20. The interval 15 is set to minimize the required number of TPR's 20 subject to incident detection time constraints. In one embodiment, the interval 15 is set to five kilometers. A plurality of the vehicles 12*a*–12*m* (generally denoted vehicles 12) traveling on roadway 10 can each include a transponder 16. Vehicles 12 so equipped can include automobiles, truck, buses, service vehicles and any type of vehicle traveling on the roadway. In operation, TPR 20*a* will detect vehicle 12 by reading transponder 16 when vehicle 12 enters a reading zone surrounding TPR 20.

As shown in FIG. 1, an incident includes a bus 14 blocking traffic causing a queue (a backlog) of vehicles (12*c*, 12*d*, 12*e* and 12*n*) to form on segment 11 (denoted $S_i$) on roadway 10. Vehicle 12*a* is shown entering the reading zone of TPR 20*a*. Vehicle 12*c* entering segment $S_i$ 11 at a earlier time was detected by TPR 20*a* and has traveled a further distance on the roadway 10 to the traffic queue caused by a traffic accident involving bus 14. TPR 20*b* which is located further down the roadway will not detect vehicle 12*c* until the traffic incident is cleared and vehicle 12*c* passes within the detection zone of TPR 20*b*. At some point in time after the incident occurs, the incident detection system 100 calculates that vehicle 12*c* is overdue at TPR 20*b*, as described below in conjunction with FIG. 3. By determining that a number of vehicles are overdue, the incident detection system 100 can detect the incident and declare that an incident has occurred before vehicle 12*c* and other overdue vehicles 12 arrive at TPR 20*b*. This novel detection method does not need to track every vehicle 12 because it indirectly senses the incident with cause a backlog without having to directly sense the backlog itself. The novel method does not require that every vehicle 12 have a transponder 16 and can accommodate vehicles 12 that stop along the roadway.

Figure 2:
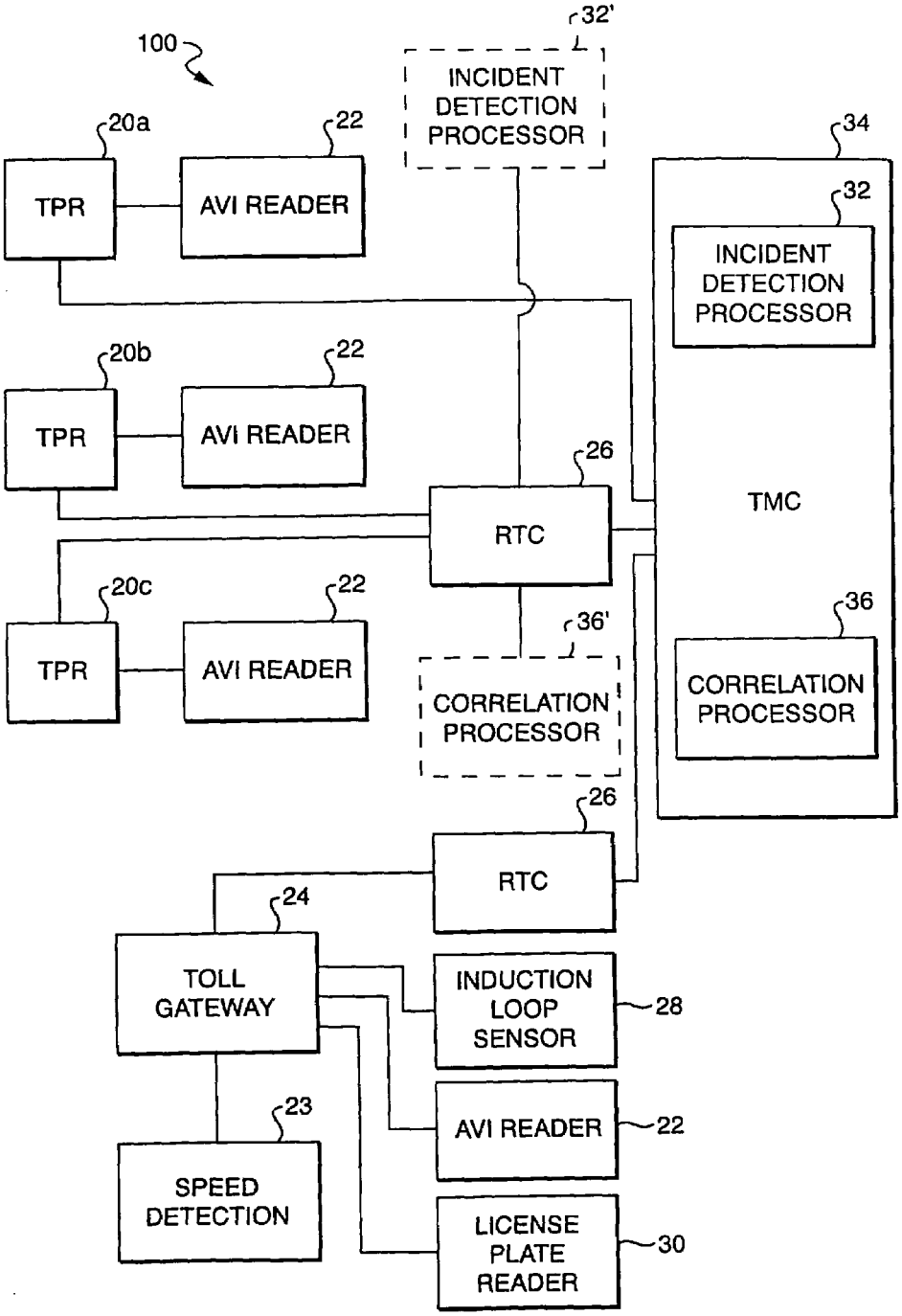
FIG. 2 is a block diagram of an incident detection system according to the invention.

Referring now to FIG. 2, a block diagram of the incident detection system 100 is shown. The incident detection system 100 includes a plurality of TPR's 20*a*–20*n* disposed at known intervals along the roadway 10. (FIG. 1) Each TPR 20 includes an automatic vehicle identification (AVI) reader 22. The TPR's 20 can be connected via a data network to the traffic management center (TMC 34) or to a roadside toll collection device (RTC) 26. The RTC's 26 can be connected to the TMC 34 or other RTC's 26. It should be appreciated that various network configurations and data transmission protocols can be used to transfer data generated at the TPR's 20 to the TMC 34 and that a direct connection from each TPR 20 to the TMC 34 is not required.

The TMC 34 includes an incident detection processor 32 and a correlation processor 36. The blocks denoted "processors" can represent computer software instructions or groups of instructions performed by a processing apparatus or a digital computer. Such processing may be performed by a single processing apparatus that may, for example, be provided as part of the TMC 34 such as that to be described below in conjunction with method described in FIG. 3. Alternatively, the processing blocks represent steps performed by functionally equivalent circuits such as a digital signal processor circuit or an application specific integrated circuit (ASIC). An optional incident detection processor 32' and an optional correlation processor 36' can be included in each of the RTC's 26 in order to distribute the data correlation and incident detection functions throughout the incident detection system 100.

The incident detection system 100 can also include a plurality of toll gateways (TG's) 24 which can be connected to an RTC 26, induction sensors 28, automatic vehicle identification (AVI) readers 22 or license plate readers 30. The TG's 24 equipped with a speed detection sensor 23 can measure the instantaneous speed of a vehicle 12 equipped with a transponder 16 at locations where the vehicle 12 is not required to stop in order for the toll collection transaction to occur.

The incident detection system 100 can operate with several types of transponders including but not limited to transponders operating under a time division multiple access (TDMA) transponder standard ASTM V.6/PS111-98, the CEN 278 standard, and the Caltrans Title 21 standard. Some transponders support writable memory, and this feature can be used to support distributed processing of the AVI data as described below.

In operation, TPR's 20, in conjunction with TG's 24, are able to individually identify each vehicle 12 based on its unique transponder 16 identification code (ID). Thus, data from multiple locations can be linked together to derive a fairly accurate estimate of travel conditions. The novel approach described herein makes more use of the available AVI data than previously contemplated in conventional systems. By indirectly sensing the queue which forms at an incident, the inventive method allows the TPR's 20 to be preferably spread out at five km intervals along the roadway while still achieving objectives to detect traffic incidents within a minimum specified period, for example five minutes. TPR's 20 are not needed at Toll Gateway locations as each TG 24 includes full TPR 20 functionality.

Each TG 24 and TPR 20 preferably contains an AVI reader capable of reading the unique thirty-two bit ID assigned to each transponder 16. It should be appreciated that the incident detection system 100 can used a variety of transponders 16 and AVI readers 22 and is not limited to readers with a thirty-two bit ID. In order to avoid erroneous reading, the transponders 16 should preferably be identified by a unique ID.

The roadside equipment, TPR's 20 and TG's 24, process each transponder's 16 data to determine the following information: (i) an indication with high confidence that the indicated transponder 16 crossed the detection location in the expected direction of travel; (ii) the date and time of detection in Universal coordinated time (UTC); (iii) the difference in time from previous detection to current detection; (iv) the location of previous detection (this information is stored in the transponder 16 memory); (v) the registered vehicle classification; (vi) the instantaneous vehicle speed collected at Toll Gateways 24 only; and (vii) an estimate of vehicle occupancy over the full-width of the roadway which is collected at Toll Gateways 24 only and typically detected by induction loop sensors. It should be noted that the system preferably operates using universal coordinated time (UTC) that is referenced to a single time zone. Preferably, the link or segment travel time, which is the difference in time between the time of a vehicle detections at the start and end of a segment 11, is accurate to within±one second. Additionally, Toll Gateways 24 can determine the count, speed, and occupancy of non-AVI vehicles which can be extrapolated to augment the AVI data produced by TPR's 20. It should be appreciated that the incident detection system 100 can be used with an open-road automatic vehicle identification tolling instead of traditional toll booths, and that the incident detection system 100 is not limited to any specific toll collection method or roadway configuration.

Typically the uniquely identified data, for example data associated with vehicles 12, and other data such as induction loop data and license plate data are transmitted over data network including fiber optics or wire transmission lines. The incident detection system 100 can also use wireless communications to collect data.

The incident detection system 100 can be included as a subsystem in an Electronic toll collection and traffic management system (ETTM) which processes toll transactions and includes additional traffic management functions.

Figure 3:
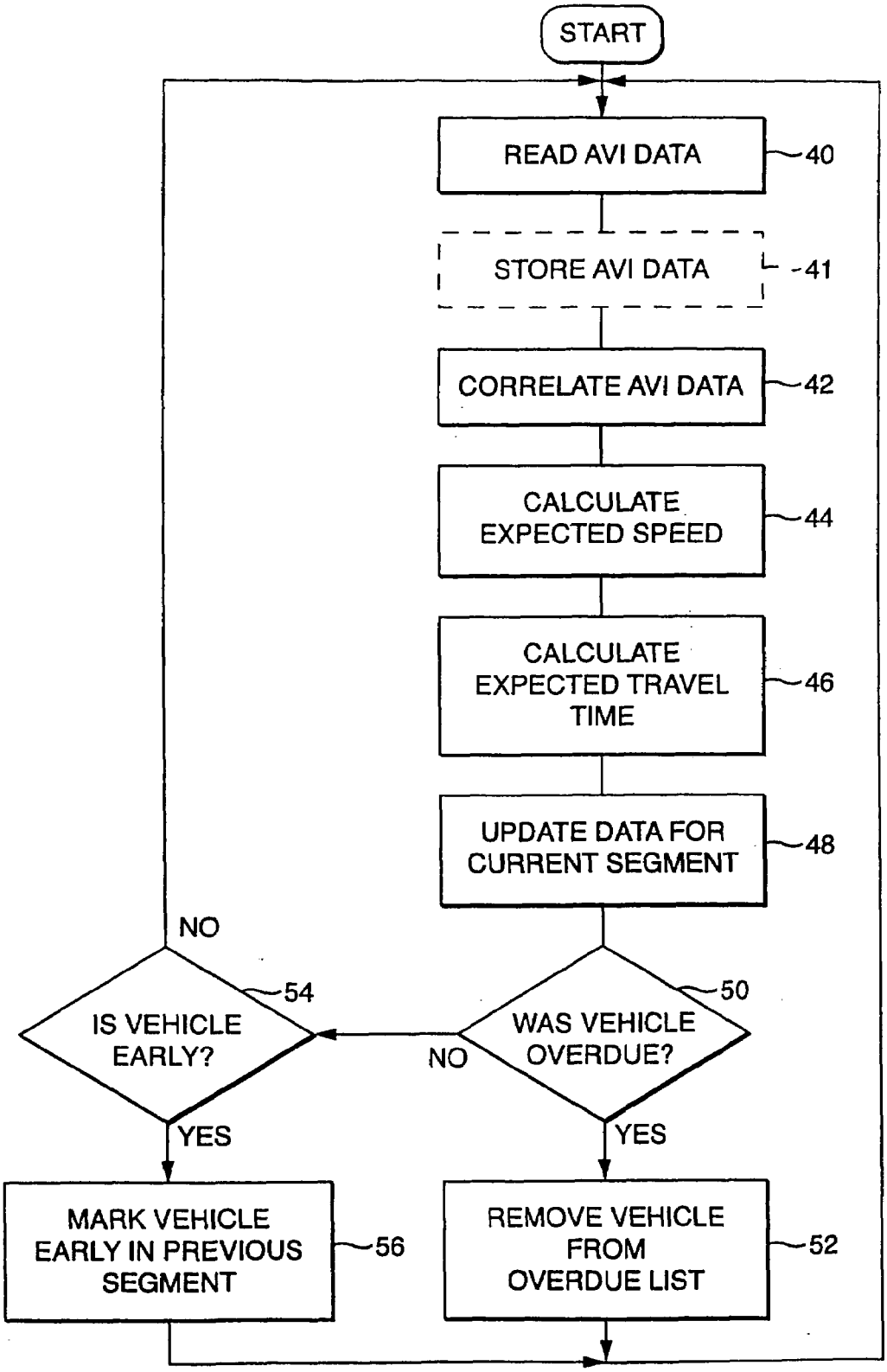
FIG. 3 is a flow diagram illustrating the steps of reading and correlating uniquely identified data.

Referring now to FIG. 3, a flow diagram illustrating the steps of reading and correlating uniquely identified data is shown. Steps 40 to 56 process uniquely identified data after it is read by AVI readers 22, loop sensors 28 and license plate readers 30 included in the incident detection system 100. It should be appreciated that the data can be processed in any one or a combination of several components in the system including TPR's 20, TG's 24, RTC's 26, correlation processors 36 and 36', incident detection processors 32 and 32' and TMC 34. Additional data that are not uniquely identified with a vehicle, for example, induction loop sensor data and roadway occupancy data can also be processed to modify the operation of the incident detection system 100.

At step 40, uniquely identified AVI data identifying each vehicle with a transponder 16 is read continuously as vehicles containing transponders 16 pass within range of AVI readers 22 connected to TPR's 20 or TG's 24. Other uniquely identified data can also be collected by automatic license plate readers 30 and by an operator entering manually read license plate data.

At step 41, additional data such as the current UTC time, and the segment number of the roadway segment being entered can be optionally written into the memory location of the transponder 16 if the transponder 16 supports this feature. The transponders 16 are typically pre-programmed with information identifying the issuing agency and registered vehicle classification. The UTC time and a roadway segment identifier are preferably written to the transponder as the vehicle 12 passes within range of the AVI readers 22.

At step 42, AVI data collected from AVI readers 22 connected to TPR's 20 and TG's 24 are correlated based on AVI unique transponder ID's. Data correlation processing can optionally occur within a correlation processor 36' connected to RTC's 26 or all of the raw AVI data can be sent to the TMC 34 and correlation processor 36. It should be appreciated that the data correlation process can be distributed among the various processing elements of the incident detection system 100 so that data is preprocessed before being sent to the TMC 34. After the data is collected and correlated in steps 40 and 42, the TMC 34 determines how many AVI equipped vehicles 12 are currently traveling within a given road segment and how much time has elapsed since each vehicle entered each segment. Correlation of the AVI data is accomplished by matching reports from adjacent sensors using the unique transponder ID's. When a report for a given transponder ID has been received from the sensor at the start of a segment 11, but not the sensor at the end of the segment 11, it is assumed that the vehicle is still traveling the given segment 11.

In steps 44–48, an expected speed and expected travel time for the next segment 11 of the roadway are calculated for the vehicle 12 that has been detected. In step 44, the expected speed for each identified vehicle 12 is calculated. For each vehicle $V_i$ entering a road segment 11 denoted $S_j$ starting Toll Gateway 24, a start speed is given by:

StartSpeed[$V_i$,$S_j$]=instantaneous speed of $V_i$ at the start of $S_j$;

Where:

$S_j$ denotes the segment 11 starting with Toll Gateway 24; and $V_i$ denotes a vehicle 12 identified by Toll Gateway's 24 AVI reader 22.

The Toll Gateway 24 can measure the speed of a vehicle as it passes without stopping.

For each vehicle 12 denoted $V_i$ entering a road segment 11 denoted $S_j$ that starts with a TPR 20 the starting speed for the segment 11 is determined from the average speed over the prior segment since a TPR 20 can not measure instantaneous speed, and is calculated by:

StartSpeed[$V_i$,$S_j$]=average speed of $V_i$ over prior segment from $S_{j-1}$ to $S_j$, computed from the length of segment $S_{j-1}$ divided by the time to complete the segment.

In step 46, the TMC 34 computes the expected speed of each vehicle $V_i$ to be the minimum of its speed as it enters a segment and the legal speed limit. The expected travel time is calculated as the length of the segment 11 divided by the calculated expected speed, using the following equations:

$$ExpSpeed[V_i, S_j] = \min(StartSpeed[V_i, S_j], HighSpeed[S_j])$$

$$ExpTime[V_i, S_j] = \frac{Length[S_j]}{ExpSpeed[V_i, S_j]}$$

where,

HighSpeed[$S_j$]=average legal speed limit over the segment starting at $S_j$

Length[$S_j$]=length of the segment starting at $S_j$

The incident detection system 100 is designed to allow extra time for a vehicle to traverse a segment 11 to avoid generating false alarms. When an actual incident occurs, it should affect a large enough number of vehicles that the incident can be detected. The incident detection system 100 allows the expected travel time to vary by vehicle, in order to account for effects such as slow moving trucks and even increase the expected travel time when a truck enters a road segment 11 containing a large grade. The expected travel time is never faster than the posted speed limit to allow for vehicles 12 that may be traveling faster than the speed limit at the start of a segment 11 but slow down within the segment 11 due to the presence of law enforcement.

At step 48, a database is updated to reflect that vehicle 12 has entered a new segment 11 along with the calculated expected speed and travel time to the next AVI reader 22. It should be appreciate that the database could be implemented as a computer database, or indexed tables. The distributed approach preferably uses a table with one row for each transponder, including the time it passed the last reader, speed, and expected time at next reader. With a centralized approach a database is used instead of indexed tables.

In decision block 50, a test is be made to determine if the recently detected vehicle 12 was considered overdue. If the vehicle was being counted as overdue, the vehicle 12 is removed from the overdue list in step 52.

In decision block 54, a test is made to determine if the recently detected vehicle 12 has arrived early. The determination of an early arriving vehicle 12 is significant to incident determination in previous segment because early arrivals can be caused by incidents in prior segments 11 that abnormally reduce traffic in subsequent sections allowing numerous early arrivals. The early arriving vehicles 12 can enter segments 11 via an on ramp or an interchange.

In a distributed correlation embodiment, the early arrival information is made available to RTC's 26 processing data from previous segments 11 because the actual early arrival might be detected by a TPR 20 or TG 24 which is controlled by a separate RTC 26.

If an incident occurs just downstream of a Toll Gateway and causes a backup to the Gateway, the algorithm will detect the incident by noting that the average vehicle speed through the Gateway is slow while the average link travel times are faster than expected for heavy congestion. Declaring an incident based on such "early arrivals" improves detection performance for incidents just beyond a Toll gateway. This is important because Toll Gateways are located near merge points which tend to have a higher rate of accidents.

It is also possible that an incident near a TPR 20 could cause slow travel times for the segment 11 prior to the TPR 20 and corresponding early arrivals for the next segment 11. This effect is due to the fact that TPR's 20 are not capable of measuring instantaneous speed. However, the primary method of detecting such incidents is through the test for overdue vehicles 12 and it is expected that the early thresholds would normally not be used for segments 11 following a TPR 20. The early thresholds are normally only used for segments following a toll gateway that can measure instantaneous speed. For segments following a TPR, incidents are only detected by counting the overdue vehicles. Steps 40–56 are repeated as additional AVI data are collected.

Figure 4:
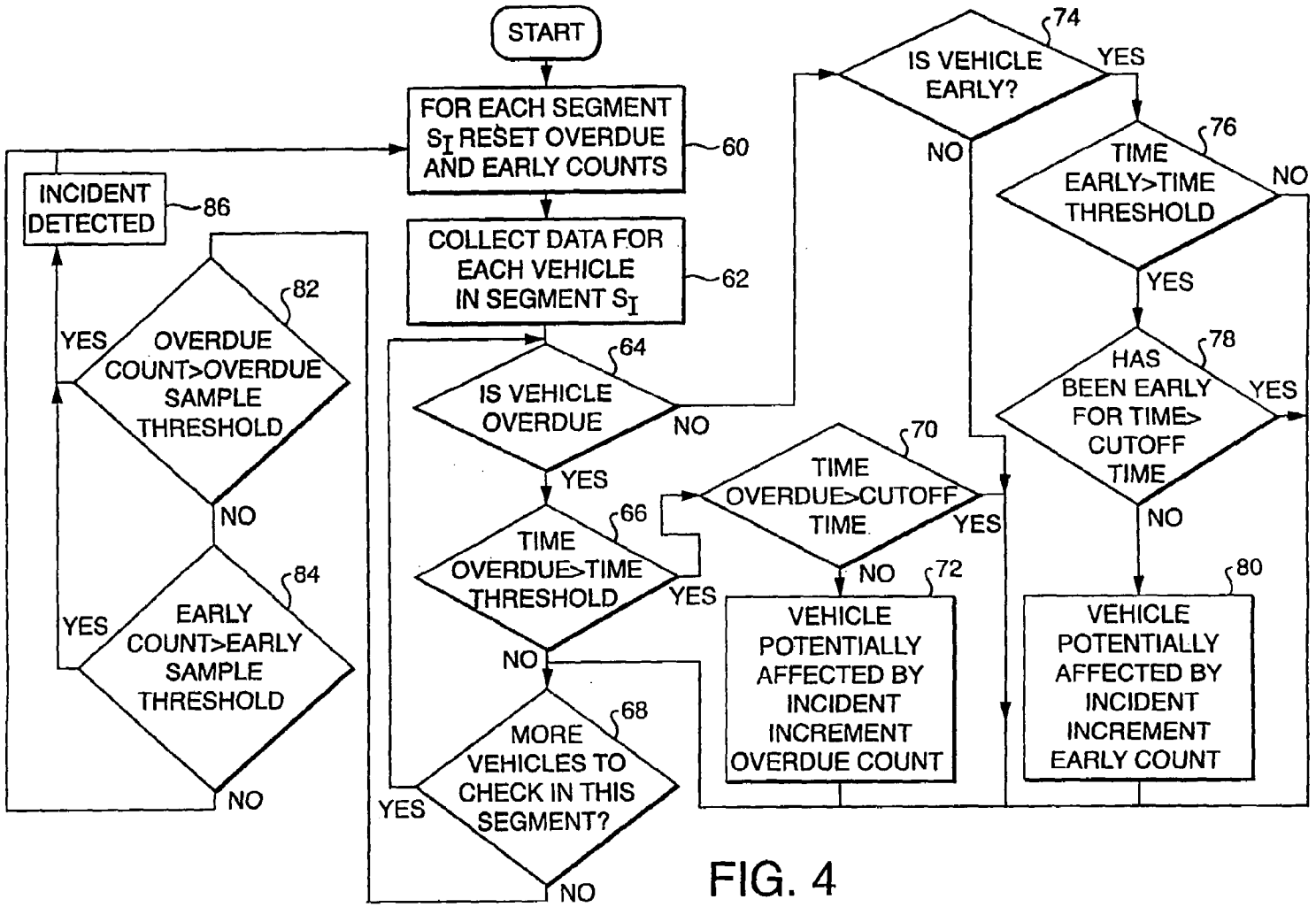
FIG. 4 is a flow diagram illustrating the steps of detecting an incident.

Referring now to FIG. 4, a flow diagram illustrating the steps of detecting an incident is shown. Steps 60–86 are repeated on a periodic basis preferably at least every twenty seconds, for each segment 11 in the roadway that is being monitored, to determine the number of vehicles 12 potentially affected by incidents along the roadway. At step 60, for each segment 11, the count of overdue and early arriving vehicles is reset to zero. At step 62, the data for each of the vehicles 12 known to have entered without leaving and those vehicles that have been reported early is collected.

In steps 64–86, an incident can be declared in either of the following ways: (i) the count of vehicles overdue by more than the applicable threshold exceeds the a predetermined sample size; or (ii) the count of vehicles that complete the segment 11 early by more than the applicable threshold over the last three minute time interval exceeds a predetermined sample size. The sample size thresholds and time thresholds can be dynamically adjusted to vary by segment 11 and other traffic conditions as described below.

In decision block 64, a determination is made whether a vehicle known to be in segment 11, $S_i$, is overdue by comparing the UTC time to the expected arrival time of the vehicle at the end of the segment 11, $S_i$. If the vehicle is overdue, processing continues in decision block 66 otherwise processing continues at step 74 to determine if the vehicle has arrived early at the end of the segment 11.

In decision block 66, the amount of time that a vehicle 12 is overdue to arrive at a TPR 20 is compared to a predetermined threshold. The elapsed time a vehicle has been traveling in a segment 11 is compared to an expected segment 11 travel time for each vehicle to determine if the vehicle is overdue and by how much time. The magnitude of the threshold is increased during periods of high total vehicle road usage to avoid declaring an incident due to transient waves of congestion. If the vehicle is not overdue by an amount of time greater than the threshold, processing continues in decision block 68 where a test is made to determine if there are more data representing vehicles 12 in the present segment 11 to process.

The overdue time for vehicle $V_i$ is calculated as follows. At any given time $t_c$ in step 66, if a vehicle $V_i$ has not been detected by the downstream sensor starting segment $S_{j+1}$, within the expected arrival time ExpTime[$V_i$,$S_j$], the vehicle 12 is initially placed been placed on an overdue list. Using the current time and the time vehicle 12 started the segment 11, the time that the vehicle 12 is actually taking to complete the segment 11 is compared to the time the vehicle 12 should have taken to complete the segment 11. Expressed as a percentage of the time the vehicle 12 should have taken to complete the segment 11, the vehicle is overdue by:

$$Overdue[V_i, S_j, t_c] = \frac{t_c - StartTime[V_i, S_j] - ExpTime[V_i, S_j]}{ExpTime[V_i, S_j]} \times 100\% \quad \text{(Equation 1)}$$

where, $t_c$=the current UTC time;

StartTime[$V_i$,$S_j$]=time that $V_i$ entered the segment starting at $S_j$; and ExpTime[$V_i$, $S_j$]=time that $V_i$ should have taken to complete the segment with sensor $S_j$.

If the overdue time for a vehicle exceeds the predetermined threshold, a test is made in decision block 70 to determine if the vehicle 12 is overdue by more than a predetermined cutoff time. The cutoff time is preferably measured starting at the time that vehicle 12 exceeds the overdue threshold rather than at the expected time of arrival. This reduces the need to artificially increase the predetermined cutoff time for a high overdue threshold.

Service stations located along the roadway can be accommodated in the algorithm by increasing the required sample size for declaring an incident on just those sections of Highway. The test in decision block 70 can disregard occasional long link travel times to allow for service station stops, breakdowns, and law enforcement stops. If the vehicle 12 is not overdue past the cutoff time, the count of overdue vehicles is incremented in step 72.

After a vehicle becomes overdue by more than the predetermined cutoff time, preferably five minutes in one embodiment, it is ignored for the remainder of that segment 11 to avoid declaring an incident due to a few vehicles stopping for some reason unconnected to a traffic incident. This nominal cutoff threshold is adjusted during initial system setup to minimize falsely detected incidents.

The overdue count is decremented by the number of vehicles 12 which are ignored for a particular segment 11 when the overdue time exceeds the cutoff threshold. Also as each overdue vehicle is detected by the reader at the end of the current segment 11, that vehicle is remove from the count of overdue vehicles.

The incident detection system 100 is designed to detect incidents that result in a queue build-up, not events such as a single vehicle breaking down without blocking traffic. When an actual incident occurs, there will be a continuing stream of overdue vehicles to trigger an incident determination in response to the comparison in decision block 82 described below.

In decision block 74, a check is made to see if the vehicle 12 has arrived early as determined in step 56. If the vehicle has arrived early processing continues at decision block 76 otherwise data collection continues at step 40.

In decision block 76, the difference between the expected and actual link travel time of any vehicle which arrives early at a TPR 20 (referred to as the early arrival time) is compared to a predetermined "Time Early" threshold. The "Time Early" time in step 76 is the difference between the actual arrival time and the expected arrival time. This is calculated at time of arrival of vehicle 12 and does not change. If the early arrival time for a vehicle exceeds the predetermined threshold, a test is made in decision block 78 to considered vehicle arriving early over some interval of time, for example the last three minutes.

The maximum of the actual time the vehicle 12 took to complete a segment 11, and the time to travel the link at the legal speed, is compared to the time the vehicle 12 should have taken to complete the segment 11. Expressed as a percentage of the time the vehicle 12 should have taken to complete the segment 11, the difference between the expected and actual link travel time for a vehicle is given by:

$$Diff[V_i, S_j] = \max\left(ActualTime[V_i, S_j], \frac{Length[S_j]}{HighSpeed[S_j]}\right) - \frac{ExpTime[V_i, S_j]}{ExpTime[V_i, S_j]} \times 100\% \quad \text{(Equation2)}$$

This difference is used to calculate early arrival time and can be used to calculate histogram of vehicle arrival times. If AVI correlation occurs at the RTC's 26, only a histogram of the number of overdue vehicles is periodically sent to the TMC 34, not the data for each individual vehicle. In the distributed correlation embodiment, each RTC sends information on each transponder that passes its last sensor to the next downstream RTC 26. The RTC's 26 have the ability to communicate directly with each other.

The history of the actual link travel time for vehicles and the difference from the expected travel time can be retained by the incident detection system 100. This information can be displayed to the operator to assist in manual incident detection and can be used for fine tuning the automated algorithm. Instead of saving the data for every vehicle that traverses a segment 11, summary histograms can be stored.

The "Has been early for time" in step 78 is the difference between the actual arrival time and the time at which the evaluation is being made. This time increases on subsequent evaluations until it finally exceeds a cutoff time. To declare an incident based on early arrivals, preferably only vehicles arriving early within the cutoff time (for example the previous three minutes) are considered. It should be appreciated that the cutoff time can be adjusted a function of segment 11 road usage and configuration. A list is maintained of each early arriving vehicle and the time at which it arrived. After a vehicle has been on the list for longer than the cutoff time, preferably three minutes, it is removed. If the vehicle has arrived early and has arrived within the cutoff interval, then the count of early arriving vehicles over a set time interval is incremented in step 80.

The magnitude of the time overdue and time early thresholds are increased during periods of high total vehicle road usage to avoid declaring an incident due to transient waves of congestion.

The tests for declaring an incident occur in decision blocks 82 and 84. In decision block 82 the number of overdue vehicles over a predetermined interval is compared to a minimum number of vehicles (the overdue sample threshold). If the count of overdue vehicles 12 is greater than the overdue sample threshold an incident is declared in step 86. If the overdue count does not exceed the sample threshold, a second test is made in decision block 84 for early arriving vehicles 12. When an incident is declared in a given segment 11, the detection logic is modified to avoid false incident detection in upstream and downstream segments 11.

In decision block 84 the number of vehicles 12 that have arrived early at a TPR 20 over a predetermined interval is compared to a minimum number of vehicles (the early sample threshold). If the count of overdue vehicles 12 is greater than the early sample threshold an incident is declared in step 86. If the early count does not exceed the early sample threshold, the overdue and early counts are reset at step 60 and data collection repeats at step 62. It should be appreciated that an incident can be detected in either the TMC 34 in incident detection processor 32 or an RTC 26 in incident detection processor 32'.

Both the overdue and early sample thresholds vary according to the current road usage. The sample thresholds are increased during periods of high AVI vehicle road usage to avoid declaring an incident based on a small percentage of the total traffic. The magnitude of the thresholds are increased during periods of high total vehicle road usage to avoid declaring an incident due to transient waves of congestion. The time thresholds are dynamically adjusted to vary by segment 11 and other traffic conditions. For example, if over a recent five minute interval the total traffic per lane at start of a segment 11 is less than 100 vehicles, the time threshold for overdue vehicles is preferably set as a percentage of the expected time equal to ten percent. The corresponding threshold for early arriving vehicles expressed as a negative percentage is set to minus thirty percent. As the traffic per lane on the segment 11 increases to greater than 150 vehicles, the time threshold for overdue vehicles is increased to twenty percent and the magnitude of the time threshold for early arriving vehicles is increased to minus fifty percent respectively. As described above, these initial nominal values are tuned to provide fewer false incident detections.

The early sample threshold is chosen to be proportional to the selected early time threshold in that shorter times require smaller sample sizes to maintain the same incident detection rate. Longer times and sample sizes increase the time to detect an incident but reduce the false alarm rate. The early sample threshold is determined based on the required incident detection rate and false alarm rate. Then, the appropriate time threshold is calculated. Finally, the parameters are tuned based on operational experience. The overdue criteria are calculated in a similar manner.

In an alternate embodiment, distributed processing in the RTC's is used to correlate the data. The RTC's 26 can retrieve data stored in transponders 16 to use information collected in a prior segment. In this embodiment, the RTC 26 determines the number of vehicles within a range of overdue times as a percentage of the expected arrival times. This information is transmitted to the TMC 34 on a periodic basis.

Use of the transponder 16 memory can reduce the amount of data that needs to be sent from one RTC 26 to the next as well as RTC processing overhead, but the same performance can be achieved in a system with non-writable transponders if sufficient inter-RTC communication and processing resources are available.

The advantage of distributed processing is a reduction in data processing and transmission because all of the individual AVI data does not have to be sent to the TMC 34. This also saves TMC 34 processing resources. The RTC 26 creates a histogram of Vehicles Currently Overdue. Table I shows an example of a histogram generated by RTC 26. These histograms are updated on a periodic basis, preferably every thirty seconds and sent to the TMC 34. The first entry in Table I indicates that at the time this set of data was calculated there were 80 vehicles that have not arrived at the end of the segment 11 where they are current located and they are within 5% to 10% overdue. For example, vehicle $\mathbf{12}_k$ has an expected travel time of 100 seconds for segment $\mathbf{11}_i$ and vehicle $\mathbf{12}_k$ transponder 16 contained data indicating that it entered segment $\mathbf{11}_i$ at UTC time 12:00.00. If the current UTC time is 12:01:46, vehicle $\mathbf{12}_k$ has been traveling in segment 11*i* for 106 seconds and is currently 6% overdue. As described above the number of vehicles in each overdue range of overdue percentages preferably excludes vehicles overdue more than 5 minutes. If a vehicle 12 traveled in a segment for 125 seconds and the expected travel time was 100 seconds, the vehicle 12 would be counted in the 20% to 25% bin.

TABLE I

| Vehicles Currently Overdue | |
|---|---|
| Time Overdue % | Number of Vehicles |
| 5% to 10% | 80 |
| 10% to 15% | 40 |
| 15% to 20% | 20 |
| 20% to 25% | 5 |
| . . . | . . . |
| >100% | 0 |

The incident detection system 100 can also operate where the roadway includes on-ramps, off-ramps, interchanges and free sections of roadway.

To declare an incident on a section of road that includes an on-ramp, the threshold for overdue vehicles is preferably increased to forty percent regardless of traffic flow. Preferably, a Toll Gateway should be located 500 meters beyond the beginning of the merge point of each on-ramp to provide updated instantaneous speed for each AVI vehicle. In cases where this is not practical, an on-ramp should be followed by two closely spaced TPR's 20. For the section of road between the TPR's 20, the threshold for overdue vehicles should be increased to 50% or more regardless of traffic flow to lessen the probability of declaring a false incident due to congestion caused by the on-ramp. The close TPR 20 spacing will make up for the loss in performance caused by increasing the threshold. Incident detection by counting early vehicles is unaffected by the presence of an on-ramp within a road segment 11.

A modified algorithm is used for segments 11 containing an off-ramp in a configuration where vehicles 12 can exit the roadway without being detected. To maximize detection performance, a TPR 20 should be located just before each off-ramp to increase the portion of the roadway on which the baseline algorithm can be used and to shorten the section within the interchange on which the modified algorithm must be used. It should be appreciated that if a TPR 20 can be placed on the off-ramp, the exiting vehicles 12 can be detected and the method described above can be used to detect incidents by recognizing that the vehicles 12 detected leaving via the off-ramp are not overdue and the normal end of segment 11.

To declare an incident in a section of the roadway that includes an off-ramp without a TPR placed on the off-ramp, it is preferably required that the number of vehicles completing the segment in less than the allowed time (the off-ramp time threshold) over the previous one minute interval does not exceed a predetermined count threshold. This test replaces the overdue test described above. For example, if between fifty and one hundred vehicles start a segment 11 in the most recent five minute interval, the arrival of three vehicles within a one minute period at the TPR 20 located at the end of the segment before the off-ramp would suppress incident detection at the normal end of the segment 11. If fewer than three vehicles arrive within the one minute period, an incident is declared.

In a further example, if two hundred fifty or greater number of vehicles 12 start segment 11 in the most recent five minute interval, the arrival of fifteen or more vehicles at the end of segment 11 would suppress incident detection. If fewer than fifteen vehicles arrive within the one minute period, an incident is declared. This prevents an incident from being declared when a reasonable number of vehicles are completing segment 11 having an unmonitored off-ramp within the allowed time. When a vehicle 12 completes a segment 11, it is counted as arriving within the allowed time if the following condition is satisfied:

$$\text{Diff}[V_i,S_j]<\text{Off-RampTime Threshold},$$

Where $\text{Diff}[V_i,S_j]$ is derived from Equation 2; and the Off-Ramp Time Threshold can vary by segment.

Incident detection by counting early vehicles is unaffected by the presence of an off-ramp within a road section except that the early vehicle sample size threshold for such sections is slightly reduced.

For a typical interchange with an off-ramp preceded by a TPR 20 and one or two on-ramps followed by a Toll Gateway, the modified algorithm and sample sizes as described above will be used with a time threshold of 40%.

A free section of the roadway is a section where no tolls are collected from any vehicle. It is expected that the number of vehicles 12 equipped with transponders 16 as a percentage of the total vehicles 12 (referred to as AVI penetration) might be a smaller in a free section. Assuming a TPR 20 is located at the start of the free section and another one is near the end of the section, the baseline algorithm will be preferably used with a time threshold of 80%. Early vehicle incident detection logic should be disabled for the road segment 11 immediately following the free section to avoid erroneously declaring an incident as the result of congestion easing.

The threshold values described in the examples above are only applicable to a particular roadway configuration. Operating threshold values will vary depending on the roadway configuration and capacity. The nominal threshold values are adjusted during initial system setup to eliminate falsely detected incidents.

All publications and references cited herein are expressly incorporated herein by reference in their entirety.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims.

What is claimed is:

1. A method of detecting an incident along a roadway, comprising the unordered steps of:

arranging a plurality of readers at intervals along a roadway for reading uniquely identified data from each one of a plurality of vehicles;

correlating the data with previously read data to obtain information regarding each one of the plurality of vehicles;

determining the number of vehicles potentially affected by incident along the roadway; and comparing the number of vehicles potentially affected by the incident to a sample threshold.

2. The method of claim 1, wherein the plurality of readers comprises a plurality of traffic probe readers.

3. The method of claim 1, wherein each one of the plurality of readers is spaced at least five kilometers from an adjacent reader.

4. The method of claim 1, wherein the information regarding each one of the plurality of vehicles comprises at least one of:

a vehicle speed;

an expected vehicle travel time for a vehicle to travel between two adjacent readers; or an expected arrival time a vehicle to arrive at one of the plurality of readers.

5. The method of claim 1, wherein the step of determining the number of vehicles potentially affected by the incident comprises the step of determining an expected arrival time for each one of the plurality of vehicles to be detected by a particular one of the plurality of readers.

6. The method of claim 5, wherein the step of determining the number of vehicles potentially affected by the incident further comprises the steps of:

determining an amount of time each one of the plurality of vehicles is overdue past the expected arrival time; and comparing the amount of time each one of the plurality of vehicles is overdue to a predetermined threshold.

7. The method of claim 6, wherein the predetermined threshold is adjusted according to the roadway usage.

8. The method of claim 5, wherein the step of determining the number of each one of the plurality of vehicles potentially affected by the incident further comprises the steps of:

determining an amount of time each one of the plurality of vehicles arrives earlier than the expected arrival time; and comparing the amount of time each one of the plurality of vehicles arrives early to a predetermined threshold.

9. The method of claim 8, wherein the predetermined threshold is adjusted according to the roadway usage.

10. The method of claim 1, further comprising detecting an incident in response to the number of the vehicles potentially affected by the incident exceeding the sample threshold.

11. The method of claim 10, wherein some of the number of vehicles potentially affected by the incident are overdue at a particular one of the plurality of readers.

12. The method of claim 10, wherein some of the number of vehicles potentially affected by the incident arrive early at a particular one of the plurality of readers.

13. The method of claim 10, wherein the number of vehicles potentially affected by the incident is counted over a predetermined time interval.

14. The method of claim 4, wherein the expected arrival time is a function of a vehicle type.

15. The method of claim 1, wherein the plurality of readers comprise respective transponder readers.

16. The method of claim 1, wherein the plurality of readers comprise respective license plate readers.

17. The method of claim 1, wherein the determining the number of vehicles potentially affected by the incident comprises determining an instantaneous speed of some of the plurality of vehicles.

18. The method of claim 5, wherein the expected arrival time for each one of the plurality of vehicles is calculated by:

$$ExpSpeed[V_i, S_j] = \min(StartSpeed[V_i, S_j], HighSpeed[S_j])$$

$$ExpTime[V_i, S_j] = \frac{Length[S_j]}{ExpSpeed[V_i, S_j]}$$

where, $V_i$ is a vehicle entering a roadway segment Sj;

ExpTime[$V_i$,$S_j$]=expected arrival time for the vehicle $V_i$;

StartSpeed[$V_i$,Sj]=starting speed of the vehicle $V_i$ at the beginning of the roadway segment $S_j$;

ExpSpeed[$V_j$,$S_j$]=expected speed of the vehicle $V_i$ over the roadway segment $S_j$;

HighSpeed [$S_j$]=average legal speed limit over the roadway segment $S_j$; and

Length [$S_j$]=length of the roadway segment $S_j$.

19. The method of claim 18, wherein an overdue time for each one of the plurality of vehicles, is calculated by:

$$Overdue[V_i, S_j, t_c] = \frac{t_c - StartTime[V_i, S_j] - ExpTime[V_i, S_j]}{ExpTime[V_i, S_j]} \times 100\%$$

where,

StartTime[$V_i$,Sj]=time that the vehicle $V_i$ entered the roadway segment $S_j$.

20. The method of claim 18, wherein a difference between the expected arrival time and an actual segment travel time for each one of the plurality of vehicles is calculated by:

$$Diff[V_i, S_j] = \frac{\max\left(ActualTime[V_i, S_j], \frac{Length[S_j]}{HighSpeed[S_j]}\right) - ExpTime[V_i, S_j]}{ExpTime[V_i, S_j]} \times 100\%;$$

where:

ActualTime[$V_i$,Sj]=actual segment travel time for the vehicle $V_j$ to travel over the roadway segment $S_j$.

21. The method of claim 18, wherein the starting speed of the vehicle $V_i$ at the beginning of the roadway segment $S_j$ is calculated by:StartSpeed[$V_i$,Sj]=average speed of the vehicle $V_i$ over a prior roadway segment.

22. The method of claim 18, wherein the starting speed of the vehicle $V_i$ at the beginning of the roadway segment $S_j$ is calculated by:StartSpeed[$V_i$,$S_j$]=instantaneous speed of the vehicle $V_i$ at the beginning of the roadway segment $S_j$.

23. The method of claim 1, further comprising the step of excluding a vehicle, which is overdue by more than a predetermined time cutoff threshold measured from a time that the vehicle is initially overdue, from being included in the number of vehicles potentially affected by the incident.

24. The method of claim 1, further comprising the step of excluding a vehicle, which has arrived early at the end of a roadway segment by more than a predetermined time cutoff threshold measured from a time that the vehicle is initially early, from being included in the number of vehicles potentially affected by the incident.

25. The method of claim 1, further comprising the step of suppressing the detection of the incident along the roadway when the number of vehicles exiting a segment of the roadway on an off-ramp over a predetermined interval of time exceeds a predetermined threshold.

26. A method for detecting an incident along a roadway, comprising the unordered steps of:

arranging a plurality of traffic probe readers at intervals along the roadway for reading a respective transponder disposed on each one of a plurality of vehicles;

correlating transponder readings from each one of the plurality of vehicles with expected readings associated with each one of the plurality of vehicles at more than one traffic probe reader to obtain at least one of a count of overdue vehicles or a count of early arriving vehicles; and detecting the incident, which results in an interruption to the flow of traffic, in accordance with the correlating.

27. The method of claim 26, further comprising the step of writing time and location data into the transponder of each one of the plurality of vehicles.

28. The method of claim 26, further comprising the step of arranging a plurality of toll gateways at intervals along a roadway for reading a respective transponder ID from a respective transponder disposed on each one of the plurality of vehicles and for determining the presence of vehicles not having a transponder.

29. An incident detection system comprising:

a traffic management center processor connected to a data network;

a plurality of unique vehicle data readers connected to said data network such that uniquely identified data are read from each one of a plurality of vehicles;

a correlation processor, wherein said uniquely identified data are correlated to obtain at least one of a count of overdue vehicles or a count of early arriving vehicles; and an incident detection processor coupled to the correlation processor and adapted to compare at least one of the count of overdue vehicles to a first sample threshold or the count of early arriving vehicles to a second sample threshold.

30. The system of claim 29 wherein said plurality of unique vehicle data readers comprise at least one of:

a plurality of traffic probe readers, each one of said plurality of traffic probe readers having unique vehicle identification on reader; or a plurality of toll gateways, each one of said plurality of toll gateways having a unique vehicle identification reader.

31. The system of claim 30 further comprising a plurality of roadside toll collection devices coupled to said plurality of toll gateways, coupled to said plurality of traffic probe readers, and coupled to said traffic management center, such that a volume of data transmitted to said traffic management center is reduced.

32. The system of claim 29 wherein said correlation processor is connected to said traffic management center processor.

33. The system of claim 29 wherein said correlation processor is connected to said plurality of unique vehicle data readers.

34. The system of claim 29 wherein said incident processor is connected to said traffic management center processor.

35. The system of claim 29 wherein said incident processor is connected to said plurality of unique vehicle data readers.

36. The apparatus of claim 29, wherein said incident detection processor is further adapted to determine an amount of time each one of the overdue vehicles is overdue past an expected arrival time, and to compare the amount of time each one of the overdue vehicles is overdue to a predetermined threshold.

37. The apparatus of claim 29, wherein said incident detection processor is further adapted to determine the amount of time each one of the early arriving vehicles is early with respect to an expected arrival time, and to compare the amount of time each one of the early arriving vehicles is early to a predetermined threshold.

* * * * *

UNITED STATES PATENT AND TRADEMARK OFFICE

CERTIFICATE OF CORRECTION

PATENT NO. : 7,145,475 B2
APPLICATION NO. : 09/805849
DATED : December 5, 2006
INVENTOR(S) : Kavner It is certified that error appears in the above-identified patent and that said Letters Patent is hereby corrected as shown below:

Column 2, line 53 delete "aspect the present" and replace with --aspect of the present--.

Column 3, line 11 delete "aspect the present" and replace with --aspect of the present--.

Column 3, line 44 delete "TPR 20)" and replace with --TPR's 20)--.

Column 3, line 57 delete "truck," and replace with --trucks,--.

Column 3, line 60 delete "TPR 20." And replace with --TPR's 20.--.

Column 3, line 65 delete "at a earlier" and replace with --at an earlier--.

Column 4, line 13 delete "the incident with cause a backlog" and replace with --the incident that caused a backlog--

Column 4, lines 20-21 delete "roadway 10. (FIG. 1)" and replace with --roadway 10 (FIG. 1).--.

Column 4, line 37 delete "with method" and replace with --with the method--.

Column 5, line 13 delete "can used" and replace with --can use--.

Column 6, line 56 delete "TPR 20 the starting" and replace with --TPR 20, the starting--.

Signed and Sealed this

Twelfth Day of June, 2007

JON W. DUDAS
*Director of the United States Patent and Trademark Office*